US007417591B2

(12) United States Patent
Iguchi et al.

(10) Patent No.: US 7,417,591 B2
(45) Date of Patent: Aug. 26, 2008

(54) ANTENNA APPARATUS AND PORTABLE WIRELESS DEVICE USING THE SAME

(75) Inventors: Akihiko Iguchi, Osaka (JP); Yuki Satoh, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 3 days.

(21) Appl. No.: 11/353,620

(22) Filed: Feb. 14, 2006

(65) Prior Publication Data

US 2006/0181468 A1 Aug. 17, 2006

(30) Foreign Application Priority Data

Feb. 17, 2005 (JP) ..... 2005-040146
Feb. 17, 2005 (JP) ..... 2005-040147

(51) Int. Cl.
*H01Q 1/24* (2006.01)
*H01Q 1/48* (2006.01)

(52) U.S. Cl. ..... 343/702; 343/702; 343/700 MS; 343/846; 343/829

(58) Field of Classification Search ..... 343/700 MS, 343/702, 846, 829
See application file for complete search history.

(56) References Cited

U.S. PATENT DOCUMENTS 6,172,646 B1 * 1/2001 Kawahata et al. ..... 343/702
6,426,723 B1 * 7/2002 Smith et al. ..... 343/700 MS
6,549,169 B1 * 4/2003 Matsuyoshi et al. ..... 343/702
6,686,886 B2 * 2/2004 Flint et al. ..... 343/702
6,867,736 B2 * 3/2005 Faraone et al. ..... 343/700 MS
6,970,135 B2 * 11/2005 Sato et al. ..... 343/702
7,075,483 B2 * 7/2006 Okado ..... 343/700 MS
7,161,543 B2 * 1/2007 Cheng et al. ..... 343/702
7,199,762 B2 * 4/2007 Liu et al. ..... 343/702
2004/0027298 A1 * 2/2004 Iguchi et al. ..... 343/702
2005/0090284 A1 * 4/2005 Yuanzhu ..... 455/558
2005/0162318 A1 * 7/2005 Higasa ..... 343/700 MS

FOREIGN PATENT DOCUMENTS

JP 2002-237779 8/2002

OTHER PUBLICATIONS

"Antenna Frequency Scaling", The ARRL Antenna Book COpy right 1988, p. 2-24 to 2-25.*

* cited by examiner

*Primary Examiner*—Trinh V Dinh
(74) *Attorney, Agent, or Firm*—RatnerPrestia

(57) ABSTRACT

An antenna apparatus and a portable wireless device using the same are disclosed, in which a coupling between antenna elements is reduced and an isolation property is improved even when frequencies of antenna elements are close or overlapped. The antenna apparatus includes a ground board, a first antenna element corresponding to a first frequency band, a second antenna element corresponding to a second frequency band in the vicinity of, or overlapped with the first frequency band, a first power feeding part connecting the ground board to the first antenna element and a second power feeding part connecting the ground board to the second antenna element, in which the first antenna element is arranged in a direction at an angle of an integer multiple of 90 degrees with respect to a long edge of the ground board, and the second antenna element is arranged in parallel with the long edge of the ground board.

26 Claims, 6 Drawing Sheets

ANTENNA APPARATUS AND PORTABLE WIRELESS DEVICE USING THE SAME

BACKGROUND OF THE INVENTION

1. Field of the Invention

The present invention relates to an antenna apparatus which corresponds to plural frequency bands and a portable wireless device using the same.

2. Description of the Related Art

On a cellular phone as a major example of portable wireless devices used for mobile communication, installations of not only a function as a telephone but also communication system functions corresponding to various applications are proceeding As examples of such functions, FM radio reception, TV reception, a GPS function, compliance to Bluetooth standard, Wireless Local Area Network (WLAN) and the like can be cited. These systems differ from one another in frequency bands to be used and wireless circuitry, therefore, antenna elements corresponding to respective systems are required.

A structure of a portable wireless device including a conventional antenna apparatus is shown in FIG. 12. Portable wireless device 105 includes an antenna apparatus having first antenna element 101, second antenna element 102 and ground board 100. First antenna element 101 and second antenna element 102 are connected to ground board 100 respectively. First antenna element corresponds to a first system in a first frequency. Second antenna element 102 corresponds to a second system in a second frequency. Accordingly, the antenna apparatus corresponding to plural systems requires plural antenna elements corresponding to respective systems. Such conventional structure is disclosed in, for example, Japanese Patent Unexamined Publication No. 2002-237779.

However, in the conventional antenna apparatus, plural antenna elements are simply arranged in a ground board, therefore, when frequencies of antenna elements are close or overlapped, problems of property deterioration by a coupling between elements, and difficulty in adjusting the element itself by the coupling can occur.

SUMMARY OF THE INVENTION

The invention provides an antenna apparatus and a portable wireless device using the same, in which a coupling between antenna elements is reduced and an isolation property is improved even when frequencies of antenna elements are close or overlapped.

The antenna apparatus of the invention includes a ground board, a first antenna element corresponding to a first frequency band, a second antenna element corresponding to a second frequency band in the vicinity of, or overlapped with the first frequency band, a first power feeding part connecting the ground board to the first antenna element and a second power feeding part connecting the ground board to the second antenna element, having a structure in which the first antenna element is arranged in a direction at an angle of an integer multiple of 90 degrees with respect to a long edge of the ground board, and the second antenna element is arranged in parallel with the long edge of the ground board. According to this, the antenna apparatus and the portable wireless device using the same, in which the coupling between antenna elements is reduced and the isolation property is improved can be provided.

DETAILED DESCRIPTION OF PREFERRED EMBODIMENTS

Hereinafter, embodiments of the invention will be explained with respect to the drawings.

First Embodiment

Figure 1:
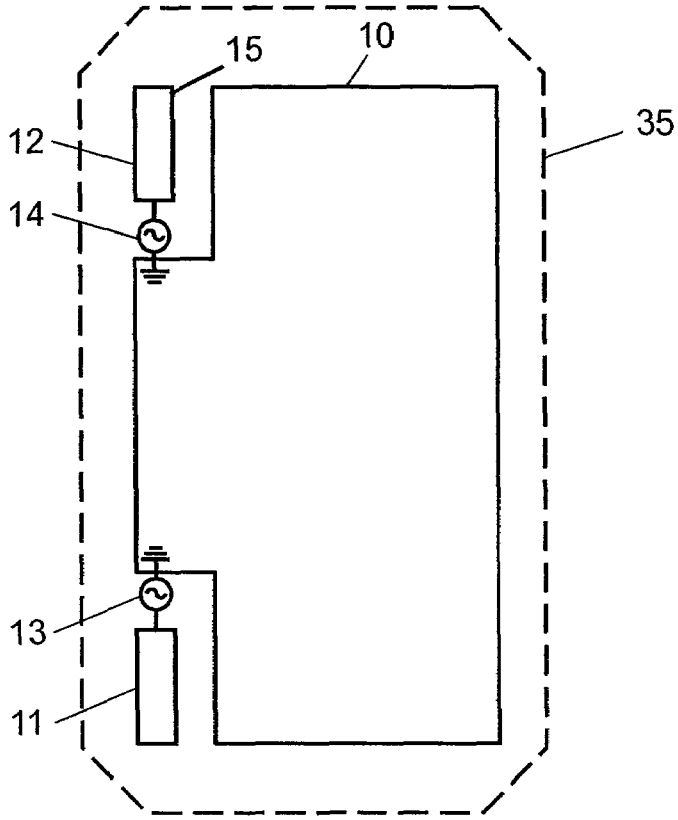
FIG. 1 is a view showing a structure of a portable wireless device including an antenna apparatus according to an embodiment of the invention.
Figure 2:
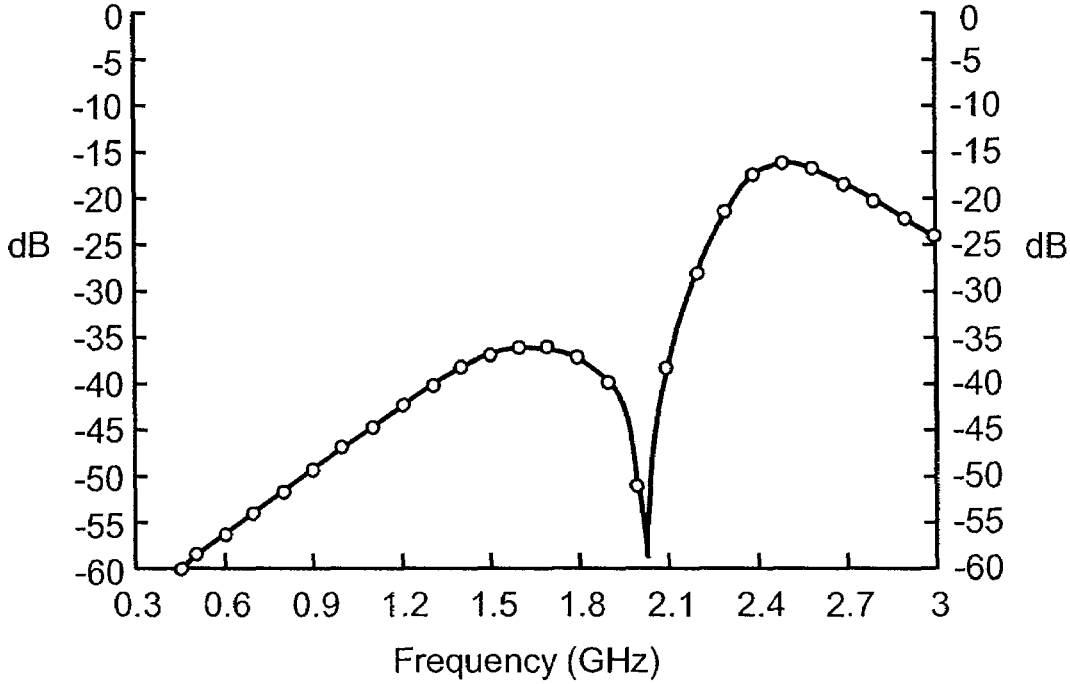
FIG. 2 is a graph showing a transmission characteristic of the antenna apparatus according to the same embodiment.
Figure 3:
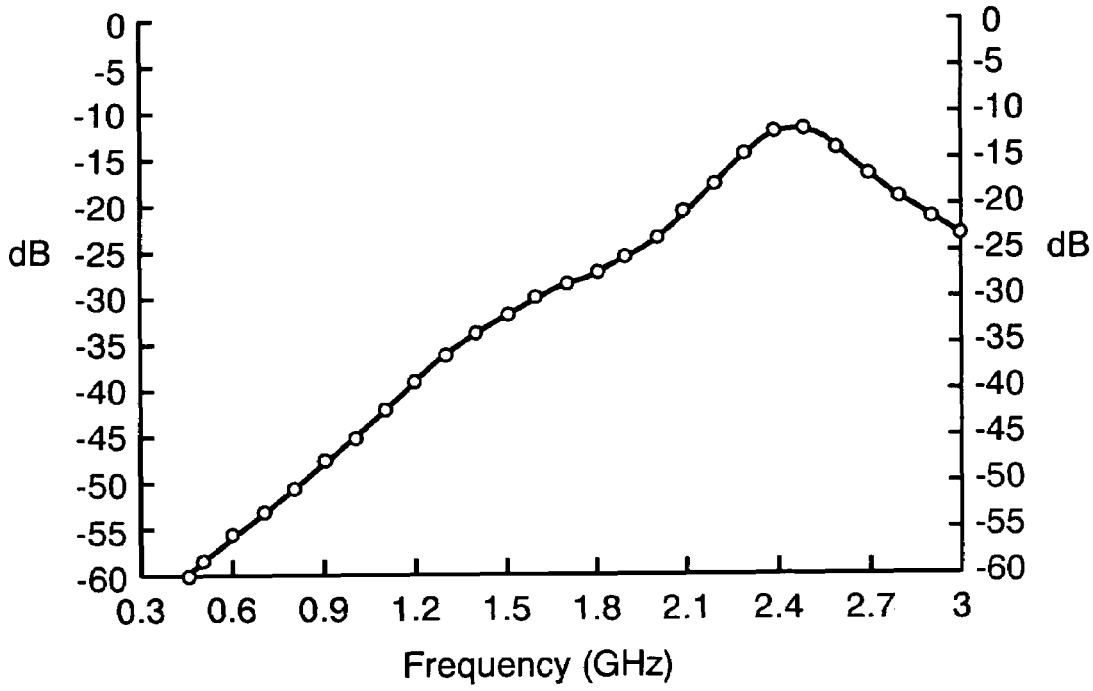
FIG. 3 is a graph showing a transmission characteristic of an antenna apparatus when two antenna elements are arranged to be orthogonal to a long edge of a ground board to be compared with the antenna apparatus according to the same embodiment.
Figure 4:
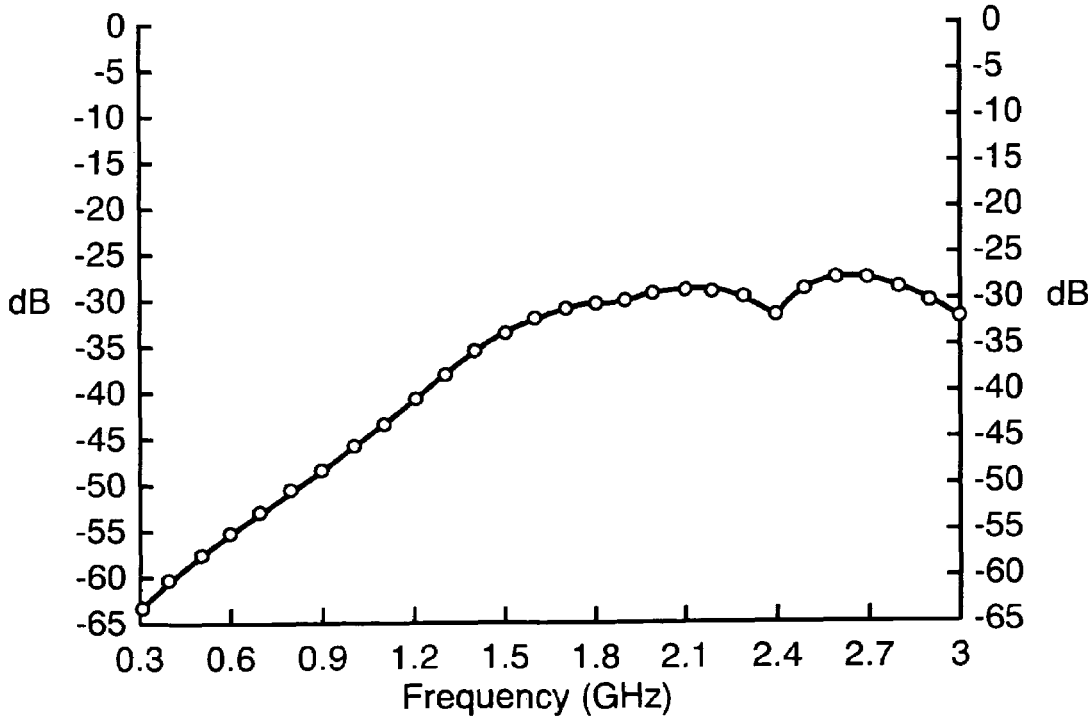
FIG. 4 is another graph showing the transmission characteristic of the antenna apparatus according to the same embodiment.

FIG. 1 is a view showing a structure of a portable wireless device including an antenna apparatus according to a first embodiment of the invention. FIG. 2 is a graph showing a transmission characteristic of the antenna apparatus according to the same embodiment. FIG. 3 is a graph showing a transmission characteristic of an antenna apparatus when two antenna elements are arranged to be orthogonal to a long edge of a ground board to be compared with the antenna apparatus according to the same embodiment. FIG. 4 is another graph showing the transmission characteristic according to the same embodiment.

In FIG. 1, portable wireless device 35 includes an antenna apparatus having ground board 10, first antenna element 11, second antenna element 12, first power feeding part 13 and second power feeding part 14. First antenna element 11 is arranged in a direction parallel (such as in portion 15) to a long edge of ground board 10, having relation of 180 degrees with respect to second antenna element 12. Second antenna element 12 is arranged in a direction parallel to the long edge of ground board 10. First power feeding part 13 feeds power to first antenna element 11. Second power feeding part 14 feeds power to second antenna element 12.

By thus arranging two antenna elements, first antenna element 11 and second antenna element 12 can direct null points which suppress radiation in each other's antenna directions. When comparing FIG. 2 with FIG. 3, in a frequency band of the antenna which is between 2.4 and 2.5 GHz, a transmission characteristic between antenna elements of the antenna apparatus according to the embodiment shown in FIG. 2 is improved by approximately 3 dB as compared with the conventional antenna apparatus shown in FIG. 3. It is found from the result that an isolation property is improved. Accordingly, an antenna apparatus in which a coupling between elements is reduced and the isolation property is improved can be obtained, further, a portable wireless device using the antenna apparatus can be obtained.

Additionally, the length of a short edge of ground board 10 is made to be the length of approximately ¼ wavelength of a predetermined frequency, thereby controlling current in a short-edge direction of ground board 10. Accordingly, an antenna apparatus in which the coupling between antenna elements through ground board 10 is further reduced and the isolation property is improved can be obtained.

A transmission characteristic between antenna elements according to the embodiment at this time is shown in FIG. 4. In the embodiment shown in FIG. 4, a pole of the transmission characteristic can be adjusted to a desired frequency band by controlling current distribution on ground board 10, therefore, the transmission characteristic can be improved as compared with FIG. 3, by approximately 15 dB in the frequency band of the antenna, that is, between 2.4 and 2.5 GHz, as a result, the isolation property can be improved.

By adjusting the frequency corresponding to antenna elements to 2.4 to 2.5 GHz which is the frequency band of Bluetooth and WLAN, an antenna apparatus complying with these applications can be obtained, further, a portable wireless device using the antenna apparatus can be obtained.

Second Embodiment

Figure 5:
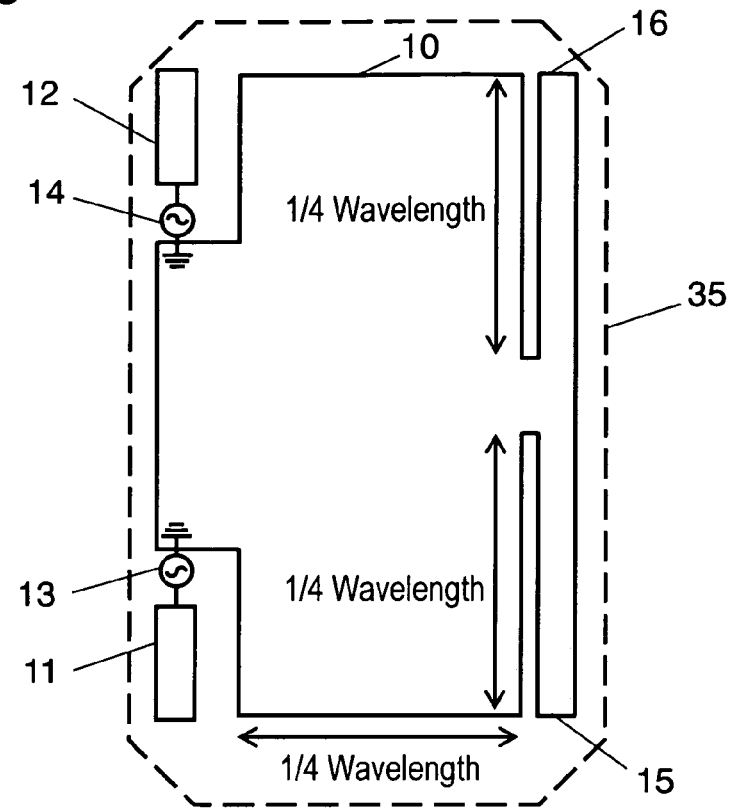
FIG. 5 is a view showing a structure of a portable wireless device including an antenna apparatus according to a second embodiment of the invention.

FIG. 5 is a view showing a portable wireless device including an antenna apparatus according to a second embodiment of the invention. In the embodiment, components having the same structures as the first embodiment are denoted by the same reference numerals and explanations thereof are omitted. In FIG. 5, first slit 15 is provided at a position corresponding to the length of approximately ¼ wavelength in a short edge at the side of antenna element 11 which is connected to ground board 10, and second slit 16 is provided at a position corresponding to the length of approximately ¼ wavelength in a short edge at the side of antenna element 12.

In the embodiment, by providing slits 15, 16 at the positions corresponding to the length of approximately ¼ wavelength in the short edges of ground board 10, the apparatus can be equivalent to the one whose short-edge length of ground board 10 is ¼ wavelength long, utilizing resonance by the slits, therefore, an isolation property can be improved and the length of the short edge of ground board 10 can be set without restraint. In addition, by making the length of slits 15, 16 be approximately ¼ wavelength of a desired frequency, the resonance at the slits can be optimized, therefore, the isolation property can be further improved.

Third Embodiment

Figure 6:
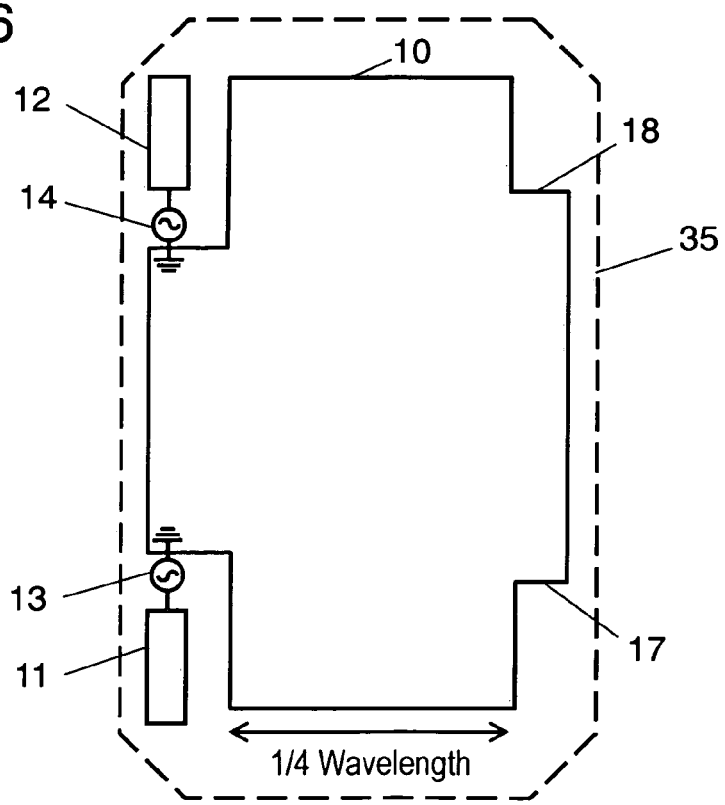
FIG. 6 is a view showing a structure of a portable wireless device including an antenna apparatus according to a third embodiment of the invention.
Figure 7:
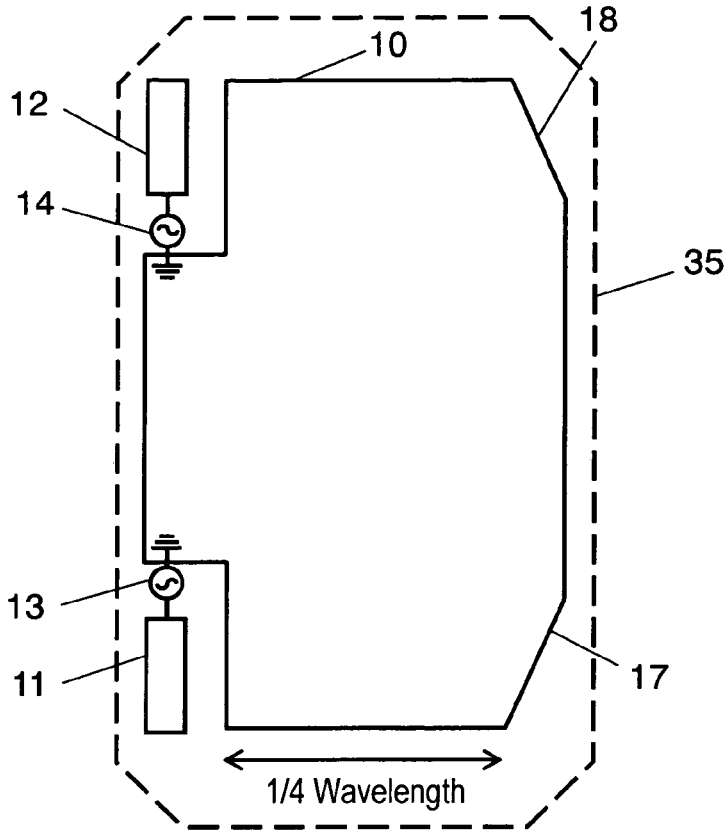
FIG. 7 is a view showing a structure of a portable wireless device including another antenna apparatus according to the same embodiment.

FIG. 6 is a view showing a structure of a portable wireless device including an antenna apparatus according to a third embodiment of the invention. FIG. 7 is a view showing a structure of a portable wireless device including another antenna apparatus according to the same embodiment. In the embodiment, components having the same structures as the first embodiment are denoted by the same reference numerals and explanations thereof are omitted. In FIG. 6, ground board 10 has first cut-out portion 17 from a position corresponding to the length of approximately ¼ wavelength in a short edge at the side of antenna element 11 to be connected, and second cut-out portion 18 from a position corresponding to the length of approximately ¼ wavelength in a short edge at the side of antenna element 12, which have respectively step-shapes. In the embodiment, by providing cut-out portions 17, 18 at positions corresponding to the length of approximately ¼ wavelength in the short edges of ground board 10, end sides of the short edges of ground board 10 can be the length of approximately ¼ wavelength of each antenna element, therefore, an isolation property can be improved and the limitation in the shape of the ground board 10 can be reduced.

Next, another structure according to the embodiment will be explained with reference to FIG. 7. In FIG. 7, a structure in which short edges of ground board 10 are cut out slantwise from positions corresponding to the length of approximately ¼ wavelength of each antenna element to form cut-out portions 17, 18 can also improve the isolation property and reduce the limitation in the shape of the ground board in the same way as the already-explained embodiment.

Fourth Embodiment

Figure 8:
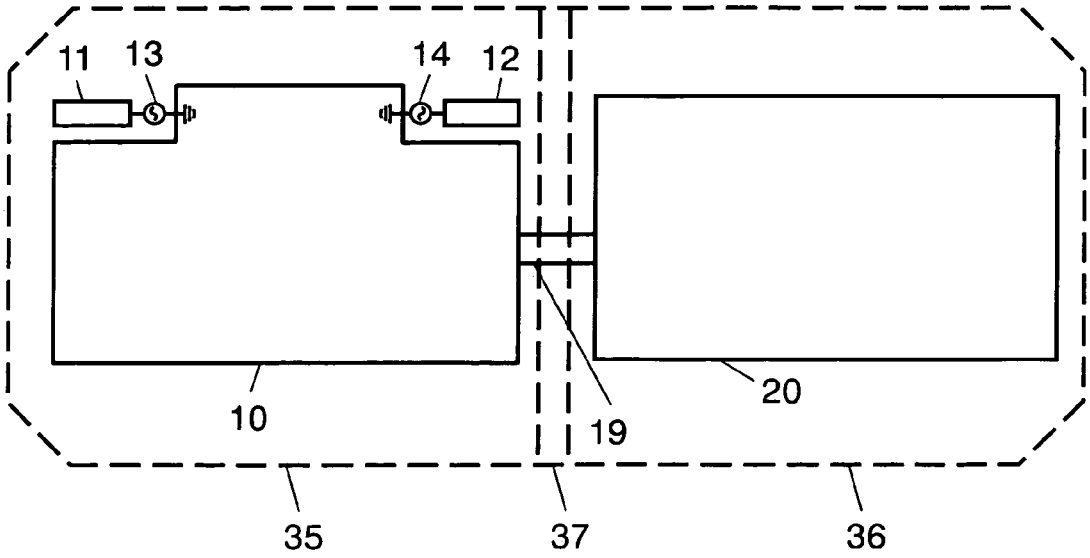
FIG. 8 is a view showing a structure of a portable wireless device including an antenna apparatus according to a fourth embodiment of the invention.

FIG. 8 is a view showing a structure of a portable wireless device including an antenna apparatus according to a fourth embodiment of the invention. In the embodiment, components having the same structures as the first embodiment are denoted by the same reference numerals and explanations thereof are omitted. In FIG. 8, ground board 10 and second ground board 20 are electrically connected through connecting part 19 which is flexible and ground boards 10, 20 have an openable/closable structure. Portable wireless device 35 has casing 36 including second ground board 20 and joint portion 37 covering connecting part 19 and having a hinge structure, which integrally form a portable wireless device.

In the embodiment, by electrically connecting second ground board 20 to ground board 10 through connecting part 19 which is flexible, it becomes possible to provide an antenna apparatus in which an isolation property is improved even in openable/closable ground boards, further, a portable wireless device using the antenna apparatus can be obtained.

Fifth Embodiment

Figure 9:
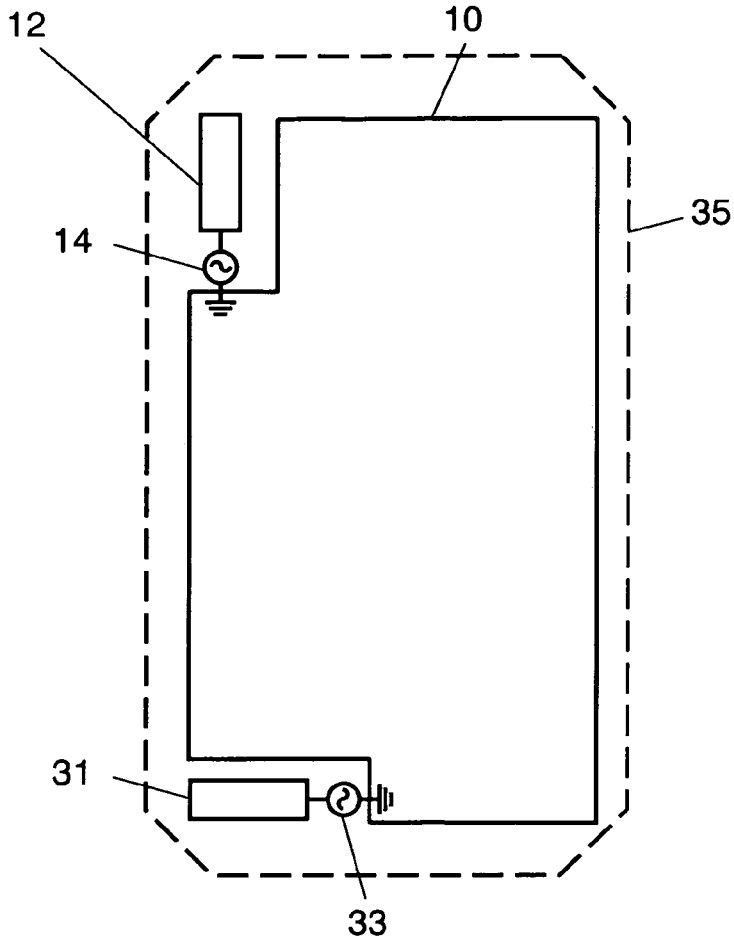
FIG. 9 is a view showing a structure of a portable wireless device including an antenna apparatus according to a fifth embodiment of the invention.
Figure 10:
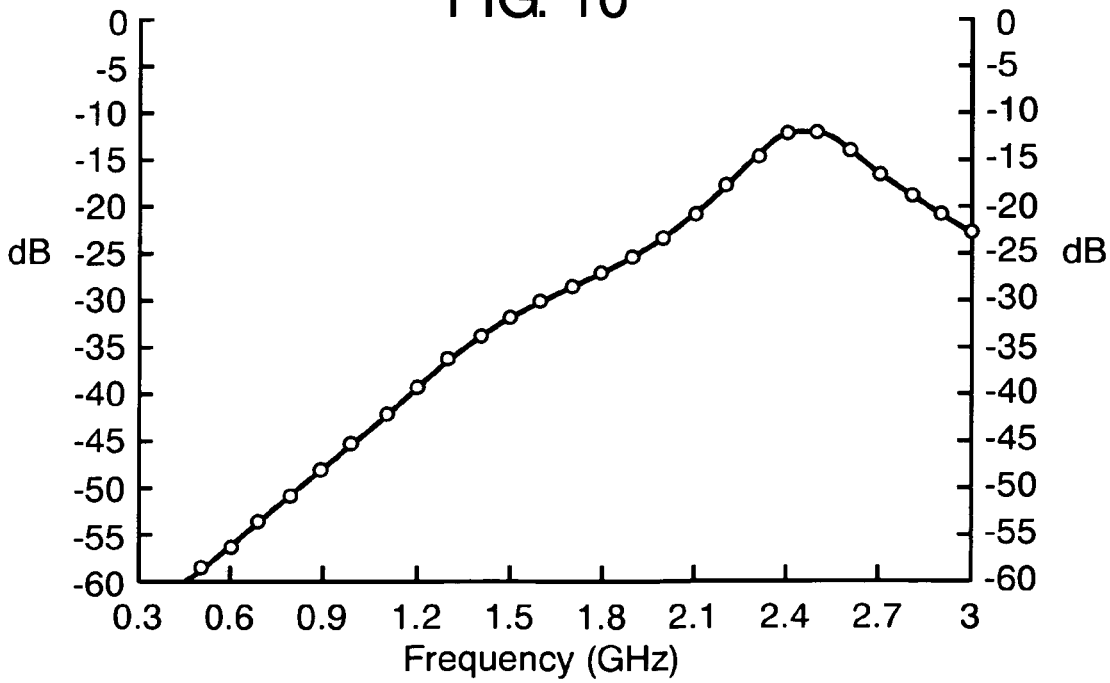
FIG. 10 is a graph showing a transmission characteristic of the antenna apparatus according to the same embodiment.

FIG. 9 is a view showing a structure of a portable wireless device including an antenna apparatus according to a fifth embodiment of the invention. FIG. 10 is a graph showing a transmission characteristic of the antenna apparatus according to the same embodiment. In FIG. 9, portable wireless device 35 includes an antenna apparatus having ground board 10, first antenna element 31, second antenna element 12, first power feeding part 33, and second power feeding part 14. First antenna element 31 is arranged in a direction orthogonal to a long edge of ground board 10, namely, at an angle of 90 degrees adding an integer multiple of 180 degrees. Second antenna element 12 is arranged in a direction parallel to the long edge of ground board 10. First power feeding part 33 feeds power to first antenna element 31. Second power feeding part 14 feeds power to second antenna element 12.

As described above, by arranging first antenna element 11 and second antenna element 12 so as to be directed in different directions, a direction in which an electromagnetic field is directed can be changed, thereby reducing a coupling between elements. In addition, by arranging elements at both end sides of the long edge of ground board 10, a distance between antenna elements can be apart, therefore, the coupling between elements can be reduced.

When comparing FIG. 10 with FIG. 3, in a frequency band of the antenna, that is, between 2.4 and 2.5 GHz, a transmission characteristic between antenna elements of the antenna apparatus according to the embodiment shown in FIG. 10 is improved by approximately 5 dB as compared with the property of the conventional antenna apparatus shown in FIG. 3, and it can be found from the result that an isolation property is improved also. Accordingly, an antenna apparatus in which the coupling between elements is reduced and the isolation property is improved can be obtained, and further, a portable wireless device using the antenna apparatus can be obtained.

By adjusting a frequency corresponding to antenna elements to 2.4 to 2.5 GHz, which is the frequency band of Bluetooth and WLAN, an antenna apparatus complying with these applications can be obtained, and further, a portable wireless device using the antenna apparatus can be obtained.

Sixth Embodiment

Figure 11:
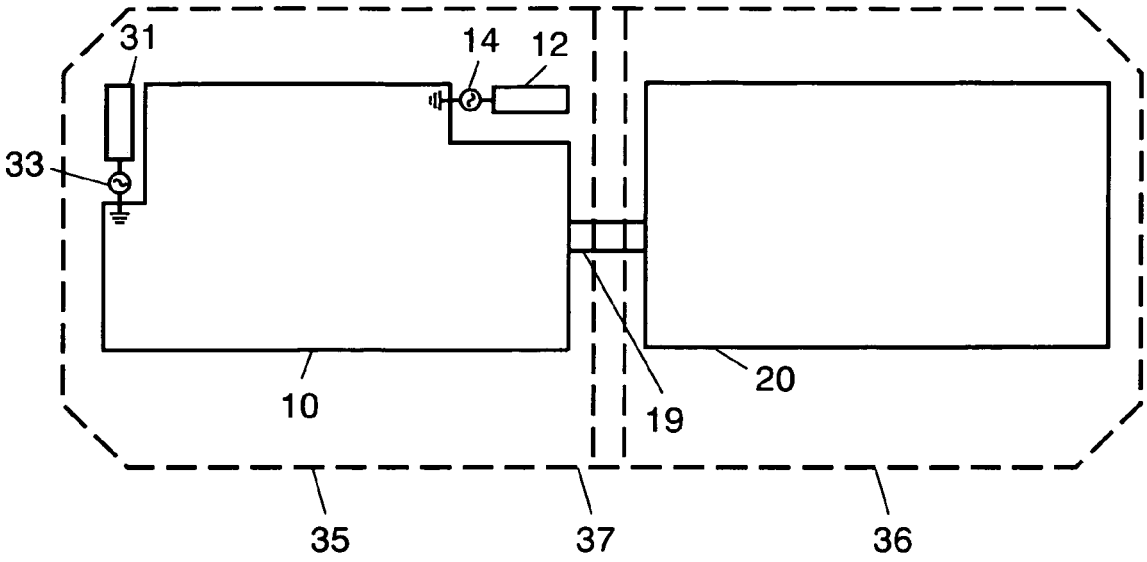
FIG. 11 is a view showing a structure of a portable wireless device including an antenna apparatus according to a sixth embodiment of the invention.
Figure 12:
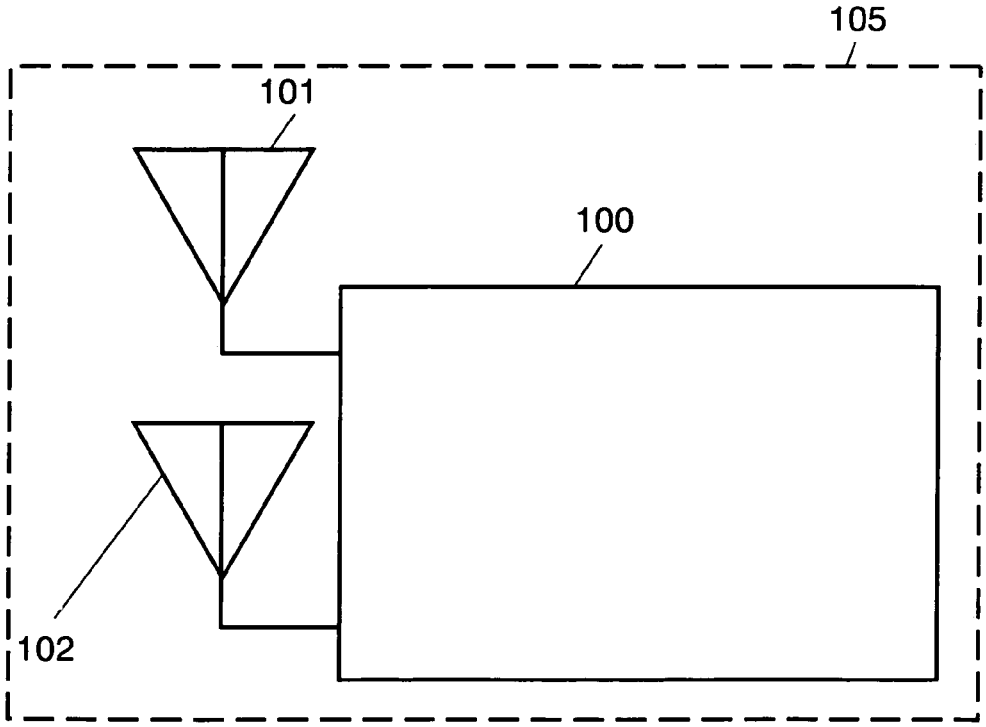
FIG. 12 PRIOR ART
FIG. 12 is a view showing a structure of a portable wireless device including a conventional antenna apparatus.

FIG. 11 is a view showing a structure of a portable wireless device including an antenna apparatus according to a sixth embodiment of the invention. In the embodiment, components having the same structures as the fifth embodiment are denoted by the same reference numerals and explanations thereof are omitted. In FIG. 11, ground board 10 and second ground board 20 are electrically connected through connecting part 19 which is flexible and ground boards 10, 20 have an openable/closable structure. Portable wireless device 35 has casing 36 including second ground board 20 and joint portion 37 covering connecting part 19 and having a hinge structure, which integrally form a portable wireless device.

In the embodiment, by electrically connecting second ground board 20 to ground board 10 through connecting part 19 which is flexible, it becomes possible to provide an antenna apparatus in which an isolation property is improved as in the fifth embodiment even in openable/closable ground boards, and further, a portable wireless device using the antenna apparatus can be obtained.

Structures of the invention are not limited to the respective embodiments, and the same effect can be obtained, for example, when applying to other apparatuses or systems, or when shapes of the slit or the cut-out formed in the ground board are modified.

The antenna apparatus and the portable wireless device according to the invention, when plural antenna elements corresponding to plural frequencies and systems are provided, reduce the coupling between antenna elements and improve the isolation property even if frequencies of antenna elements are close or overlapped, therefore, the antenna apparatus is useful for a small cellular phone and the like using plural applications as systems.

What is claimed is:

1. An antenna apparatus, comprising:

a ground board;

a first antenna element corresponding to a first frequency band;

a second antenna element corresponding to a second frequency band in the vicinity of, or overlapped with the first frequency band;

a first power feeding part connecting the ground board to the first antenna element; and a second power feeding part connecting the ground board to the second antenna element, wherein the first antenna element is arranged in a direction at an angle of an integer multiple of 90 degrees with respect to a first substantially straight edge of the ground board, and the second antenna element is arranged in parallel with the first edge of the ground board; and wherein the length of a second substantially straight edge of the ground board is made to be longer than ¼ wavelength of the first frequency band or the second frequency band, and a slit is provided at a position of the second edge of the ground board, the position being located at approximately ¼ wavelength of the first frequency band or the second frequency band from a corner where the second edge meets the first edge of the ground board.

2. The antenna apparatus of claim 1, wherein the integer multiple of 90 degrees is made to be an integer multiple of 180 degrees.

3. The antenna apparatus of claim 1, wherein the length of the slit is made to be approximately ¼ wavelength of the first frequency band or the second frequency band.

4. The antenna apparatus of claim 1, wherein the integer multiple of 90 degrees is made to be 90 degrees+an integer multiple of 180 degrees.

5. The antenna apparatus of claim 1, wherein another ground board is electrically connected to the ground board through a connecting part which is flexible, and the ground board and the another ground board have an openable/closable structure.

6. The antenna apparatus of claim 1, wherein the first frequency band is specific to Bluetooth, and the second frequency band complies with Wireless Local Area Network.

7. The antenna apparatus of claim 1, wherein said antenna apparatus is included in a portable wireless device.

8. The antenna apparatus of claim 1, wherein said at least one of the first and second antenna elements has a portion which is parallel to the ground board and which is not superimposed over the ground board.

9. The antenna apparatus of claim 8, wherein the first power feeding part and the second power feeding part are arranged in parallel to the first edge of the ground board.

10. The antenna apparatus of claim 1, wherein the first power feeding part and the second power feeding part are arranged in parallel to the first edge of the ground board.

11. An antenna apparatus comprising:

a ground board;

a first antenna element corresponding to a first frequency band;

a second antenna element corresponding to a second frequency band in the vicinity of, or overlapped with the first frequency band;

a first power feeding part connecting the ground board to the first antenna element; and a second power feeding part connecting the ground board to the second antenna element, wherein the first antenna element is arranged in a direction at an angle of an integer multiple of 90 degrees with respect to a first substantially straight edge of the ground board, and the second antenna element is arranged in parallel with the first edge of the ground board, and wherein the length of a second substantially straight edge of the ground board is made to be longer than ¼ wavelength of the first frequency band or the second frequency band, and a cut-out portion is provided in a slantwise direction from a position of the second edge of the ground board, the position being located at approximately ¼ wavelength of the first frequency band or the second frequency band from a corner where the second edge meets the first edge of the ground board.

12. The antenna apparatus of claim 11, wherein said antenna apparatus is included in a portable wireless device.

13. The antenna apparatus of claim 11, wherein the integer multiple of 90 degrees is made to be an integer multiple of 180 degrees.

14. The antenna apparatus of claim 11, wherein the integer multiple of 90 degrees is made to be 90 degrees+an integer multiple of 180 degrees.

15. The antenna apparatus of claim 11, wherein another ground board is electrically connected to the ground board through a connecting part which is flexible, and the ground board and the another ground board have an openable/closeable structure.

16. The antenna apparatus of claim 11, wherein said at least one of the first and second antenna elements has a portion which is parallel to the ground board and which is not superimposed over the ground board.

17. The antenna apparatus of claim 16, wherein the first power feeding part and the second power feeding part are arranged in parallel to the first edge of the ground board.

18. The antenna apparatus of claim 11, wherein the first power feeding part and the second power feeding part are arranged in parallel to the first edge of the ground board.

19. An antenna apparatus comprising:

a ground board;

a first antenna element corresponding to a first frequency band;

a second antenna element corresponding to a second frequency band in the vicinity of, or overlapped with the first frequency band;

a first power feeding part connecting the ground board to the first antenna element; and a second power feeding part connecting the ground board to the second antenna element, wherein the first antenna element is arranged in a direction at an angle of an integer multiple of 90 degrees with respect to a first substantially straight edge of the ground board, and the second antenna element is arranged in parallel with the first edge of the ground board, and wherein the length of a first substantially straight edge of the ground board is made to be longer than ¼ wavelength of the first frequency band or the second frequency band, and a cut-out portion having a step-shape is provided from a position of the second edge of the ground board, the position being located at approximately ¼ wavelength of the first frequency band or the second frequency band from a corner where the second edge meets the first edge of the ground board.

20. The antenna apparatus of claim 19, wherein said antenna apparatus is included in a portable wireless device.

21. The antenna apparatus of claim 19, wherein the integer multiple of 90 degrees is made to be an integer multiple of 180 degrees.

22. The antenna apparatus of claim 19, wherein the integer multiple of 90 degrees is made to be 90 degrees+an integer multiple of 180 degrees.

23. The antenna apparatus of claim 19, wherein another ground board is electrically connected to the ground board through a connecting part which is flexible, and the ground board and the another ground board have an openable/closeable structure.

24. The antenna apparatus of claim 19, wherein said at least one of the first and second antenna elements has a portion which is parallel to the ground board and which is not superimposed over the ground board.

25. The antenna apparatus of claim 24, wherein the first power feeding part and the second power feeding part are arranged in parallel to the first edge of the ground board.

26. The antenna apparatus of claim 19, wherein the first power feeding part and the second power feeding part are arranged in parallel to the first edge of the ground board.

* * * * *